US012232546B2

(12) United States Patent
Suess et al.

(10) Patent No.: US 12,232,546 B2
(45) Date of Patent: Feb. 25, 2025

(54) BRA WITH INTERMEDIARY FLEXIBLE LAYER AND METHOD FOR MANUFACTURING SAME

(71) Applicant: Chico's Brands Investments, Inc., Fort Myers, FL (US)

(72) Inventors: Emily Suess, Fort Myers, FL (US); Valerie Ann McArdle, Fort Myers, FL (US)

(73) Assignee: Chico's Brands Investments, Inc.

( * ) Notice: Subject to any disclaimer, the term of this patent is extended or adjusted under 35 U.S.C. 154(b) by 0 days.

(21) Appl. No.: 17/175,110

(22) Filed: Feb. 12, 2021

(65) Prior Publication Data

US 2022/0256941 A1 Aug. 18, 2022

(51) Int. Cl.

| | |
|---|---|
| ***A41C 3/00*** | (2006.01) |
| ***A41C 3/12*** | (2006.01) |
| ***A41C 3/14*** | (2006.01) |

(52) U.S. Cl.

CPC ..... *A41C 3/0014* (2013.01); *A41C 3/0021* (2013.01); *A41C 3/124* (2013.01); *A41C 3/144* (2013.01)

(58) Field of Classification Search

CPC ..... A41C 3/0014; A41C 3/0021; A41C 3/124; A41C 3/144

USPC ..... 450/60, 61

See application file for complete search history.

(56) References Cited

U.S. PATENT DOCUMENTS

| | | | | |
|---|---|---|---|---|
| 2,041,066 | A * | 5/1936 | Howard | A41C 3/144 2/237 |
| 2,149,819 | A * | 3/1939 | Rubinstein | A41C 3/00 450/63 |
| 2,560,706 | A * | 7/1951 | Spetalnik | A41C 3/0021 450/74 |
| 2,624,049 | A * | 1/1953 | Granne | A41D 10/00 450/67 |
| 2,761,147 | A * | 9/1956 | Gluckin | A41C 3/0007 450/52 |

(Continued)

FOREIGN PATENT DOCUMENTS

| | | |
|---|---|---|
| CA | 2750309 A1 | 3/2012 |
| WO | 2018022239 A1 | 2/2018 |

OTHER PUBLICATIONS

International Search Report and Written Opinion of the International Searching Authority issued on Jul. 1, 2022 for International Application No. PCT/US22/16363.

(Continued)

*Primary Examiner* — Jocelyn Bravo

(74) *Attorney, Agent, or Firm* — Kelley Drye & Warren LLP

(57) ABSTRACT

A bra and method of manufacturing the same that is designed to (1) provide the optimum level of support, comfort, fit and coverage to a wearer of the bra, (2) visually enhance the wearer's figure by preventing cup gaping and side and top overflow or bulging, and (3) improve the breathability of the bra, thereby reducing sweat and irritation of the skin on or around the wearer's breasts. The bra of the present disclosure comprises bra cups that include intermediary flexible layers that are configured such that they allow the bra cups to stretch and contract to accommodate and fit snugly around the wearer's breasts.

15 Claims, 4 Drawing Sheets

(56) References Cited

U.S. PATENT DOCUMENTS 2,890,702 A * 6/1959 Farino ..... A41C 3/0021 450/63
2,967,527 A * 1/1961 Maas ..... A41C 3/06 450/52
3,372,698 A 3/1968 Gingras
3,378,012 A * 4/1968 Schwartz ..... A41C 3/0007 450/60
3,396,729 A * 8/1968 Glick ..... A41C 3/142 450/52
3,439,682 A * 4/1969 Defru ..... A41C 3/0071 450/86
3,566,878 A * 3/1971 Radomski ..... A41C 3/00 450/74
3,773,052 A * 11/1973 Belardinelli ..... A41C 3/00 450/36
3,834,397 A * 9/1974 Birch ..... A41C 3/10 450/56
3,952,752 A * 4/1976 Huttle, Jr. ..... A41C 3/0021 450/60
4,816,004 A * 3/1989 Emanuel ..... A41C 3/144 450/55
4,875,236 A * 10/1989 Boynton ..... A41D 7/00 2/403
5,116,278 A * 5/1992 Sroub ..... A41C 3/00 450/67
5,215,494 A * 6/1993 Flanagan ..... A41C 3/0007 2/73
5,820,444 A * 10/1998 McGaughey ..... A41C 3/0064 450/70
6,000,994 A * 12/1999 Salotto ..... A41C 3/0014 2/243.1
6,106,363 A * 8/2000 Werner ..... A41C 3/122 450/52
6,162,111 A 12/2000 Heroff
6,190,232 B1 * 2/2001 Boser ..... A41C 3/0007 450/47
6,846,219 B2 * 1/2005 Moyer ..... A41C 3/00 450/86
6,896,580 B2 * 5/2005 Falla ..... A41C 3/122 450/41
6,918,812 B2 * 7/2005 Giese ..... A41C 3/0021 450/75
6,997,775 B2 2/2006 Jagaric et al.
7,556,553 B2 * 7/2009 Falla ..... A41C 5/005 450/39
7,618,304 B2 11/2009 Chen
7,666,058 B2 * 2/2010 Smith ..... A61F 13/141 450/20
RE41,654 E 9/2010 Struble et al.
7,806,748 B2 10/2010 Richardson
7,922,560 B2 * 4/2011 Avalos-Dessner ..... A41C 3/144 450/39
8,277,276 B2 * 10/2012 Waitz ..... A41C 3/10 450/39
8,523,629 B2 * 9/2013 Pundyk ..... A41C 3/0057 450/36
8,758,082 B1 * 6/2014 Woods ..... A41C 3/04 450/86
9,289,017 B2 * 3/2016 Raven ..... A41C 3/144
9,386,808 B2 * 7/2016 Turlan-Van Der Hoeven ..... A41C 3/10
9,596,892 B1 3/2017 Kornas
9,717,284 B2 * 8/2017 Misseldine ..... A41C 3/0007
9,943,119 B2 4/2018 Solotoff
9,961,944 B2 5/2018 Fayad
D822,341 S * 7/2018 Rendone ..... D2/706
10,660,375 B2 5/2020 Agee
11,051,964 B1 * 7/2021 Lee ..... A41C 3/005
2005/0221718 A1 * 10/2005 Falla ..... A41C 3/0021 450/66
2007/0026767 A1 * 2/2007 Scheininger ..... A41C 3/0028 450/39
2010/0015886 A1 * 1/2010 Waitz ..... A41C 3/10 450/86
2010/0255755 A1 * 10/2010 Rose ..... A41C 3/10 450/55
2013/0183885 A1 * 7/2013 Yamazaki ..... A41C 3/00 450/59
2016/0044970 A1 * 2/2016 Yuasa ..... A41C 3/0021 450/52
2017/0156413 A1 * 6/2017 Braverman ..... A41C 3/10

OTHER PUBLICATIONS

International Search Report and Written Opinion of the International Searching Authority issued on Jun. 2, 2022 for International Application No. PCT/US22/16364.

* cited by examiner

BRA WITH INTERMEDIARY FLEXIBLE LAYER AND METHOD FOR MANUFACTURING SAME

CROSS-REFERENCE TO RELATED APPLICATIONS

The present application is related to a co-pending application filed on the same date as the present application by inventors Emily Suess and Valerie Ann McArdle and Applicant Chico's Brands Investments, Inc., entitled "Bra Pad and Method for Manufacturing Same." This co-pending application is incorporated herein by reference in its entirety, including its specification, and is not admitted to be prior art with respect to the present application by its identification in this "cross-reference" section.

FIELD

The present disclosure relates generally to the field of bras and related garments, and more specifically, to a new and useful bra having an intermediary flexible layer disposed between the bottom of each of the bra cups and the respective underwire channels to provide an improved level of support, comfort, fit and coverage for use as a standalone bra or in camisoles, tank tops, slips, dresses, bathing suits or any other breast covering garment where support, comfort and flexibility is desired.

BACKGROUND

As is well understood in the art, a brassiere, or "bra" for short, is a form-fitting undergarment designed to support, cover, restrain, reveal, modify, and/or elevate the wearer's breasts. Traditionally, bras have two cups, one for receiving and supporting each of the breasts of the wearer as well as shoulder straps and a band or wings to secure the bra to the user. The band of the bra extends around the torso of the wearer and under the breasts of the wearer when the bra is worn. The shoulder straps are designed to rest securely on the wearer's shoulders. Specifically, each shoulder strap is attached to the bra such that one end of the shoulder strap is attached near the top of a respective bra cup and the other end is attached near the top of the band or wings, creating loops to receive the wearer's arms. To put the bra on, arms of the wearer may be inserted through the loops created by the shoulder straps and the wings may be attached around the wearer's back using a traditional prong and hook configuration. Bras are designed to lift the bra cups upwardly with respect to the breasts of the wearer to provide support and comfort to the wearer. The band and/or the shoulder straps of the bra are designed to assist in achieving that result. Traditionally, the cups of the bra may have an underwire for shaping and/or forming the cups to correspond to the shape of the wearer's breasts as well as to provide additional support to the wearer's breasts.

Traditional bras have been determined to provide inadequate support to the wearer and are known to be uncomfortable. For example, the underwire or the shape and rigidness of the bra cups may be uncomfortable and/or inadequate for comfortably supporting the wearer's breasts. Further, bra cups often shift upwards or "ride up" on the wearer's breasts resulting in an uncomfortable fit. Still further, inadequate support of the wearer's breasts may cause the breasts to contact an area of the wearer's skin adjacent to or under the wearer's breasts which may cause excess heat build-up, sweating and/or fungal growth in those areas. Moreover, bras and their corresponding components (e.g., cups, shoulder straps and/or band) may fit too tightly in certain areas, resulting in cup and side overflow as well as painful pinching or irritation of the wearer's breasts. Conversely, bras and their corresponding components (e.g., cups, shoulder straps and/or band) may fit too loosely and therefore may not provide adequate support, comfort, or fit.

In light of the above, wearers are constantly seeking more supportive and comfortable bras that address some or all of the aforementioned issues. However, a need remains for a bra to be more flexible in certain areas, yet remain stable and rigid in others to address some or all of the aforementioned issues and provide improved and optimum support, comfort, fit and coverage to the wearer.

Additionally, it is well known that a woman's weight may fluctuate 5 to 6 pounds throughout the day, which can cause a bra to become too tight or too loose on the wearer, and therefore become uncomfortable or unable to provide adequate support to the wearer's breasts, or both. As such, a need exists for a bra that can stretch or flex to the shape of the wearer as a wearer's weight increases, as well as to recover or contract back to the shape of the wearer as the wearer's weight decreases so as to maintain optimal support, comfort, fit and coverage to the wearer throughout extended periods of time.

SUMMARY

The present disclosure describes articles of clothing, such as standalone bras and bras built into articles of clothing, such as camisoles, tank tops, slips, dresses, bathing suits, or any other breast covering garment where support, comfort and/or coverage of the wearer's breasts is desired, that (1) improve the level of support, comfort, fit and coverage provided to a wearer of the bra or garment containing the bra disclosed herein, (2) visually enhance the wearer's figure by preventing cup gaping and side and top overflow or bulging, and (3) improve the breathability of the bra. It should be understood that the use of the term "bra" herein refers to articles of clothing, such as standalone bras and bras built into any of camisoles, tank tops, slips, dresses, bathing suits, or any other breast covering garment where support, comfort and/or coverage of the wearer's breasts is desired.

In one aspect of the present disclosure, the article of clothing described herein is designed to (1) provide the optimum level of support, comfort, fit and coverage to a wearer of the bra, (2) visually enhance the wearer's figure by preventing cup gaping and side and top overflow or bulging, and (3) improve the breathability of the bra, thereby reducing heat, sweat and irritation of the skin on or around the wearer's breasts. To achieve these results, the bra comprises bra cups or bra pads that are configured such that they can stretch and contract to accommodate and fit snugly around the wearer's breasts, including at the neckline of the wearer. It should be understand that the use of the term "bra cup(s)" herein refers to both bra cups and bra pads.

In one aspect of the present disclosure, an article of clothing to support the breasts of a wearer is provided. The article of clothing comprises (1) first and second laterally positioned bra cups configured to receive the breasts of the wearer, each bra cup having an inner edge and an outer edge, wherein the inner edges of the bra cups are near the sternum of the wearer, and the outer edges of the bra cups are near the sides of the wearer's body when worn; (2) first and second intermediary flexible layers, wherein the top portion of the first intermediary flexible layer is connected along the bottom portion of the first bra cup, and the top portion of the second intermediary flexible layer is connected along the bottom portion of the second bra cup; and (3) first and second bust support members, wherein the top portion of the first bust support member is connected to the bottom portion of the first intermediary flexible layer and the top portion of the second bust support member is connected to the bottom portion of the second intermediary flexible layer. It should be understood that the article of clothing of the present disclosure may comprise a one-piece cup or panel configured to receive the breasts of a wearer, and is not limited to two separate bra cups.

In another aspect of the present disclosure, an article of clothing to support the breasts of a wearer is provided. The article of clothing comprises at least one bra cup configured to receive the breasts of the wearer, the at least one bra cup having first and second side edges, wherein the first side edge of the at least one bra cup is near the left side of the wearer's body, and the second side edge of the at least one bra cup is near the right side of the wearer's body when the article of clothing is worn; at least one intermediary flexible layer, wherein the top portion of the at least one intermediary flexible layer is connected along the bottom portion of the at least one bra cup; and at least one bust support member, wherein the top portion of the at least one bust support member is connected to the bottom portion of the at least one intermediary flexible layer.

In another aspect of the present disclosure, an article of clothing to support the breasts of a wearer is provided. The article of clothing comprises: first and second laterally positioned bra cup configurations. The first bra cup configuration comprises: (1) a first bra cup configured to receive one of the breasts of the wearer, the first bra cup having an inner edge and an outer edge, (2) a first bust support member having an inner edge and an outer edge, wherein the first bust support member is connected to the first bra cup near their respective inner edges and their respective outer edges such that a space is formed between the first bra cup and the first bust support member, and (3) a first intermediary flexible layer disposed within the space formed between the first bra cup and the first bust support member, wherein the first intermediary flexible layer is configured to connect a portion of the first bra cup to the first bust support member. The second bra cup configuration comprises: (1) a second bra cup configured to receive one of the breasts of the wearer, the second bra cup having an inner edge and an outer edge, wherein the inner edges of the first and second bra cups are near the sternum of the wearer, and the outer edges of the first and second bra cups are near the sides of the wearers body when worn, (2) a second bust support member having an inner edge and an outer edge, wherein the second bust support member is connected to the second bra cup near their respective inner edges and their respective outer edges such that a space is formed between the second bra cup and the second bust support member, and (3) a second intermediary flexible layer disposed within the space formed between the second bra cup and the second bust support member, wherein the second intermediary flexible layer is configured to connect a portion of the second bra cup to the second bust support member.

In another aspect, the bra of the present disclosure comprises two bra cups for receiving the breasts of the wearer and a bottom support component, such as an underwire channel, band, panel and the like. Each bra cup is configured such that at least a portion of the bottom edge of the bra cup is not directly affixed to the bottom support component of the bra (e.g., the underwire channel, band, or similar support component). Instead, an intermediary flexible layer is provided between the aforementioned portion of the bottom edge of the bra cup and the bottom support component, such that the intermediary flexible layer connects that portion of the bottom edge of the bra cup to the bottom support component. The intermediary flexible layer comprises stretchable material such as LYCRA®, spandex, elastane, rubber, polyester, nylon and the like, and allows the bra cup to stretch away from and contract back to the bottom support component, as needed, to accommodate the wearer's breasts. The intermediary flexible layer may also comprise additional or excess fabric, which may also be made from LYCRA®, spandex, elastane, rubber, polyester, nylon and the like, to allow the bra cup to stretch even further, if necessary.

The size of the portion of the bottom edge of the bra cup that is connected to the bottom support component via the intermediary flexible layer directly affects the stretch-ability of the bra cup. For example, if all or nearly all of the bottom edge of the bra cup is connected to the bottom support component via the intermediary flexible layer, the bra cup is configured such that it can achieve maximum stretch-ability. Conversely, if only a small portion of the bottom edge of the bra cup is connected to the bottom support component via the intermediary flexible layer, the bra cup will be comparatively less stretchable.

In another aspect of the present disclosure, and in order to provide bra cups that are both flexible and supportive, each bra cup may only be directly affixed to the bottom support component at two points: (1) at a first or inner edge near where the two bra cups meet, and (2) the opposite edge of the bra cups where the bra cup is affixed to the back panel, cradle, or side, near the underarm portion of the bra. This configuration creates a space between the bra cup and the bottom support component where they are not connected. In one aspect of the present disclosure, the intermediary flexible layer is provided in this space and indirectly connects the bottom edge of the bra cup and the top portion of the bust support member. All three components, the bra cup, intermediary flexible layer, and bottom support component, may be affixed together at the two aforementioned points. In this configuration, the bra cups can stretch to accommodate the wearer's breasts.

In yet another aspect of the present disclosure, the excess fabric of the intermediary flexible layer may taper as it approaches each of the two aforementioned connection points where the bra cup is affixed to the bust support member so that there is less or negligible excess fabric at those connection points. With less or negligible excess fabric, the bra cup's ability to stretch at the connection points is reduced, which makes the connection points more rigid and provides further support to the wearer's breasts, if necessary.

Another aspect of the present disclosure is directed to a method of manufacturing the above described bra. The method comprises the steps of: providing two bra cups for receiving the breasts of the wearer; affixing an intermediary flexible layer along a portion of the bottom edge of each of the bra cups; and affixing a bottom support component to the bottom edge of each of the intermediary flexible layers, such that each bottom support component is not directly affixed to at least a portion of the corresponding bra cup.

Another aspect of the present disclosure is directed to a method of manufacturing an article of clothing. The method comprising the steps of: (1) providing first and second laterally positioned bra cups configured to receive the breasts of the wearer, each bra cup having an inner edge and an outer edge, wherein the inner edges of the bra cups are near the sternum of the wearer, and the outer edges of the bra cups are near the sides of the wearer's body; (2) affixing a first intermediary flexible layer to the first bra cup, wherein the top portion of the first intermediary flexible layer is connected along the bottom portion of the first bra cup, (3) affixing a first bust support member to the first intermediary flexible layer, wherein the top portion of the first bust support member is connected to the bottom portion of the first intermediary flexible layer; (4) affixing a second intermediary flexible layer to the second bra cup, wherein the top portion of the second intermediary flexible layer is connected along the bottom portion of the second bra cup; and (5) affixing a second bust support member to the second intermediary flexible layer, wherein the top portion of the second bust support member is connected to the bottom portion of the second intermediary flexible layer. It should be understood that the article of clothing of the present disclosure may comprise a one-piece cup or panel configured to receive the breasts of a wearer, and is not limited to two separate bra cups.

Numerous variations of the bras and supportive garments described herein may be practiced in the preferred embodiment. Other features and advantages of the subject matter described herein will be apparent from the description and drawings, and from the claims.

BRIEF DESCRIPTION OF THE DRAWINGS

A further understanding of the subject matter described herein can be obtained by reference to exemplary embodiments set forth in the illustrations of the accompanying drawings. Although the illustrated embodiments are merely exemplary of apparatuses described herein, both the organization and method of operation and manufacture thereof, in general, together with further objectives and advantages thereof, may be more easily understood by reference to the drawings and the following description. Like reference numbers generally refer to like features (e.g., functionally similar and/or structurally similar elements).

The drawings are not necessarily depicted to scale; in some instances, various aspects of the subject matter disclosed herein may be shown exaggerated or enlarged in the drawings to facilitate an understanding of different features. Also, the drawings are not intended to limit the scope of this invention, which is set forth with particularity in the claims as appended hereto or as subsequently amended, but merely to clarify and exemplify the present disclosure.

DETAILED DESCRIPTION

Figure 1:
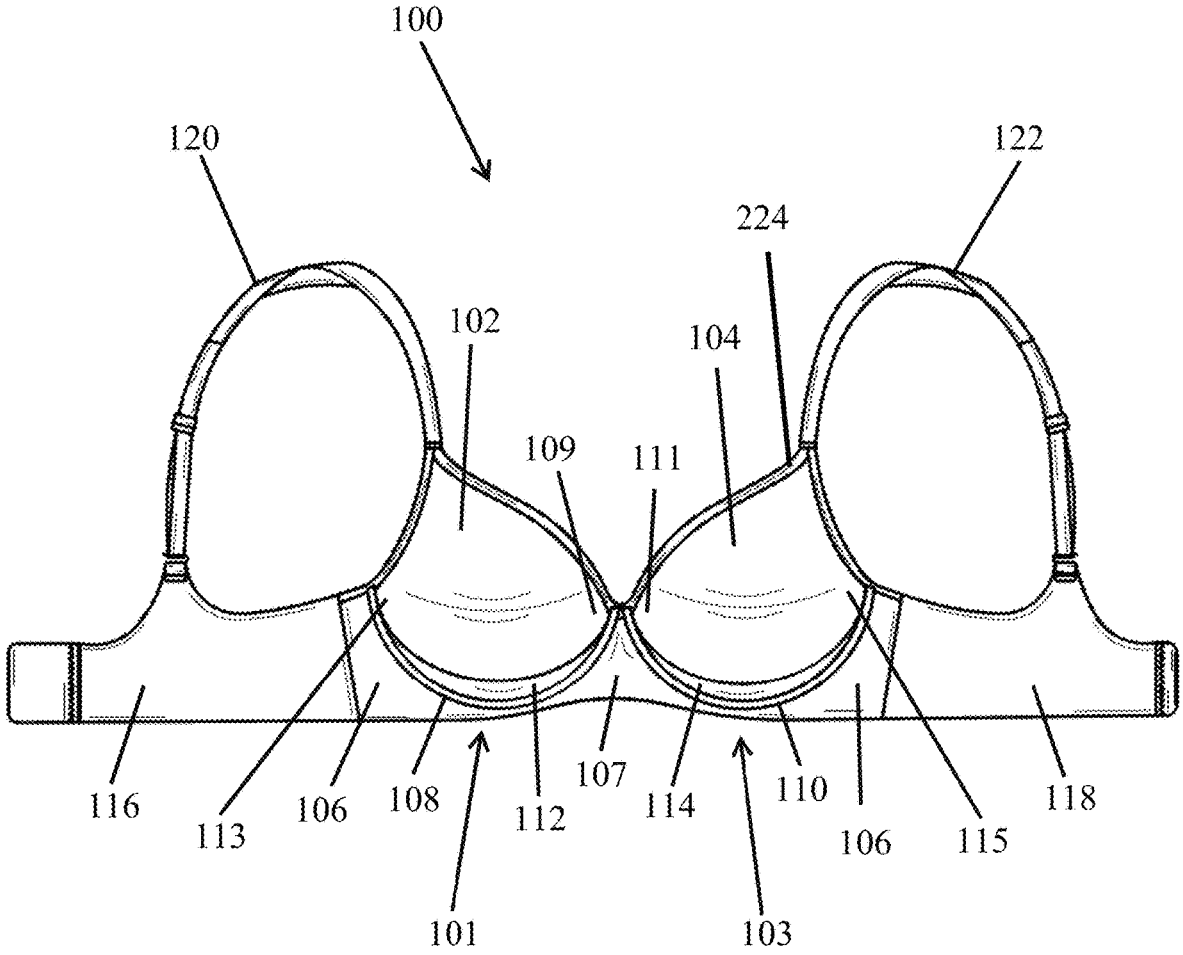
FIG. 1 depicts a rear view of a bra in accordance with an exemplary embodiment of the present disclosure.

The present disclosure may be understood more readily by reference to the following detailed descriptions of exemplary embodiments of the subject matter disclosed herein. However, devices, apparatuses, systems, and structures in accordance with the present disclosure may be embodied in a wide variety of forms and modes, some of which may be quite different from those in the disclosed embodiments. Also, the features and elements disclosed herein may be combined to form various combinations without exclusivity, unless expressly stated otherwise. Consequently, the specific structural and functional details disclosed herein are merely representative. Yet, in that regard, they are deemed to afford the best embodiments for purposes of disclosure and to provide a basis for the claims herein, which define the scope of the invention. It should also be noted that, as used in the specification and the appended claims, the singular forms "a", "an", and "the" include plural referents unless the context clearly indicates otherwise.

Use of the term "exemplary" means illustrative or by way of example, and any reference herein to "the invention" is not intended to restrict or limit the present disclosure to the exact features of any one or more of the exemplary embodiments disclosed herein. Also, repeated use of the phrase "in one embodiment," "in an exemplary embodiment," or similar phrases do not necessarily refer to the same embodiment, although they may. It is also noted that terms such as "preferably," "commonly," and "typically," are not used herein to limit the scope of the claimed invention or to imply that certain features are critical, essential, or even important to the structure or function of the claimed invention. Rather, those terms are merely intended to highlight alternative or additional features that may or may not be used in a particular embodiment of the present disclosure.

The present disclosure is directed to an article of clothing, such as a bra, and, particularly, to a bra that (1) provides the optimum level of support, comfort, fit and coverage to a wearer of the bra, (2) visually enhances the wearer's figure by preventing cup gaping and side and top overflow or bulging, and (3) improves the breathability of the bra, thereby reducing heat, sweat and irritation of the skin on or around the wearer's breasts. In certain embodiments, the bra comprises bra cups or bra pads that are configured such that they can stretch and contract to accommodate and fit snugly around the wearer's breasts. In other words, so that the bra cups can move with the wearer in order to improve wearer comfort and prevent unsightly cup bulging or gaping. To achieve these benefits, each bra cup comprises an intermediary flexible layer between the bottom of the bra cup and the support band, which allows the bra cup to freely stretch away from the support band, as needed. The intermediary flexible layer is also able to fully recover and contract, when necessary, so that the bra cups remain snugly against the wearer's breasts.

FIGS. 1-4 illustrate an exemplary embodiment of bra (100) in accordance with the present disclosure. Referring first to FIG. 1, there is shown a rear view of bra (100). As shown, bra (100) comprises two laterally-spaced bra cups (102 and 104), a front support panel (106), bust support members or underwire channels (108 and 110), an upper edge portion (224), and intermediary flexible layers (112 and 114).

Front support panel (106) of bra (100) is illustrated as including two laterally-positioned bra cups (102 and 104) configured to receive the wearer's breasts; however, depending on the type of bra, the cups may be replaced by a single cup or panel. As shown, each bra cup (102 and 104) has an inner edge (109 and 111), respectively, and an outer edge (113 and 115), respectively, wherein inner edges (109 and 111) are near the sternum of the wearer, and outer edges (113 and 115) are near the respective sides of the wearer's body when bra (100) is worn. Bra cups (102 and 104) may be any known bra cup in the art and may be formed of a sturdy generally inelastic material or, alternatively, may be constructed of an elastic material, which still provides support, but is also stretchable to accommodate the wearer's breasts. Moreover, bra (100) may incorporate the bra pads taught and disclosed in co-pending application filed on the same date as the present application by inventors Emily Suess and Valerie Ann McArdle and Applicant Chico's Brands Investments, Inc., entitled "Bra Pad and Method for Manufacturing Same."

Below each bra cup (102 and 104) is provided bust support member or underwire channel (108 and 110), respectively, which are attached to front support panel (106). Bust support members may be underwire channels (108 and 110) housing underwire (not shown) therein, which are commonly used in the art to increase the sturdiness of bra cups and thus provide additional support to the wearer's breasts. It should be understood that the present disclosure is not limited to underwire channels (108 and 110) and that any bottom or bust support member that provides support to bra cups (102 and 104), such as underwire channels, a support panel made from rigid material, a band, and the like, may be used with bra (100). Bust support members, such as underwire channels (108 and 110), may be omitted from bra (100) as well. It is also noted that illustrated bra cups (102 and 104) are full coverage cups, which cover over 50% of the wearer's breasts; however, it should be appreciated that smaller or larger bra cups may be used in connection with the bra of the present disclosure.

As shown in FIG. 1, between each bra cup (102 and 104) and underwire channel (108 and 110) is provided intermediary flexible layer (112 and 114), respectively. As will be described in detail below, intermediary flexible layers (112 and 114) comprise stretchable material such as LYCRA®, spandex, elastane, rubber, polyester, nylon and the like, and are provided to allow bra cups (102 and 104), respectively, to stretch away from and contract back to underwire channels (108 and 110), as needed, to accommodate the wearer's breasts. Intermediary flexible layers (112 and 114) may also comprise additional or excess fabric, which may also be made from LYCRA®, spandex, elastane, rubber, polyester, nylon and the like, to allow the bra cup to stretch even further, if necessary. Bra cup (102), underwire channel (108) and intermediary flexible layer (112) together are referred to as bra cup configuration (101). Likewise, bra cup (104), underwire channel (110) and intermediary flexible layer (114) together are referred to as bra cup configuration (103).

Bra (100) may also have certain elements and components that a conventional bra in the art may have. For example, bra (100) may comprise three distinct support panel segments: a front support panel (106), a left support panel (116), and a right support panel (118), which in combination are used to attach bra (100) around a wearer's torso. Front support panel (106) comprises left and right bra cups (102 and 104, respectively) for receiving the breasts of the wearer and, to the extent bra cups are not directly attached, comprises fabric portion (107) that extends in-between and connects bra cups (102 and 104) together. Left support panel (116) is attached to and extends away from the left side of front support panel (106) and right support panel (118) is attached to and extends away from the right side of front support panel (106). Front support panel (106), left support panel (116) and right support panel (118) may be comprised of any suitably flexible, yet sturdy material known in the art. To secure bra (100) to the wearer, left and right support panels (116 and 118) are extended around the left and right side of the wearer's torso, respectively, and may be fastened together against the wearer's back using fastening means known in the art, such as a releasable clasp, a hook-and-eye fastening system, toggles and loops, hook and loop fasteners, snaps, buckles, tie-able ribbons or strings, a button and hole combination, and the like. Bra (100) may also be constructed such that the support panel is fastened in the front between bra cups (102 and 104) at point (107) using the same or similar fastening means. Alternatively, and as well known in the art, bra (100) may comprise a one-piece, single support cup or panel, without a fastener, in lieu of the three distinct aforementioned support panel segments.

Bra (100) may also comprise left and right shoulder straps (120 and 122) respectively, that, when bra (100) is worn, bridge the front and back portions of bra (100) and are provided over the shoulders of the wearer. One end of straps (120 and 122) are preferably affixed to the top portion of bra cups (102 and 104), respectively. At the other end, straps (120 and 122) are preferably affixed to the top portion of left and right support panels (116 and 118), respectively. Bra straps (120 and 122) may be comprised of any material known or used in the art. Bra straps (120 and 122) are provided largely to assist in keeping bra (100) in place on the wearer and to provide additional support and lift to the wearer's breasts. It is further contemplated that one or more portions of the underside surface of shoulder straps (120 and 122) may be comprised of LYCRA®, spandex, elastane, rubber, polyester, nylon or the like to prevent shoulder straps (120 and 122) from slipping off the wearer's shoulders. Alternatively, bra (100) may be strapless, or comprise straps that are removable or adjustable such that the straps may cross-over in the front or the back of bra (100), or the straps may be connected in any other feasible manner. Further, straps (120 and 122) may be affixed to bra (100) such that they are adjustable, as is commonly known in the art.

Figure 2:
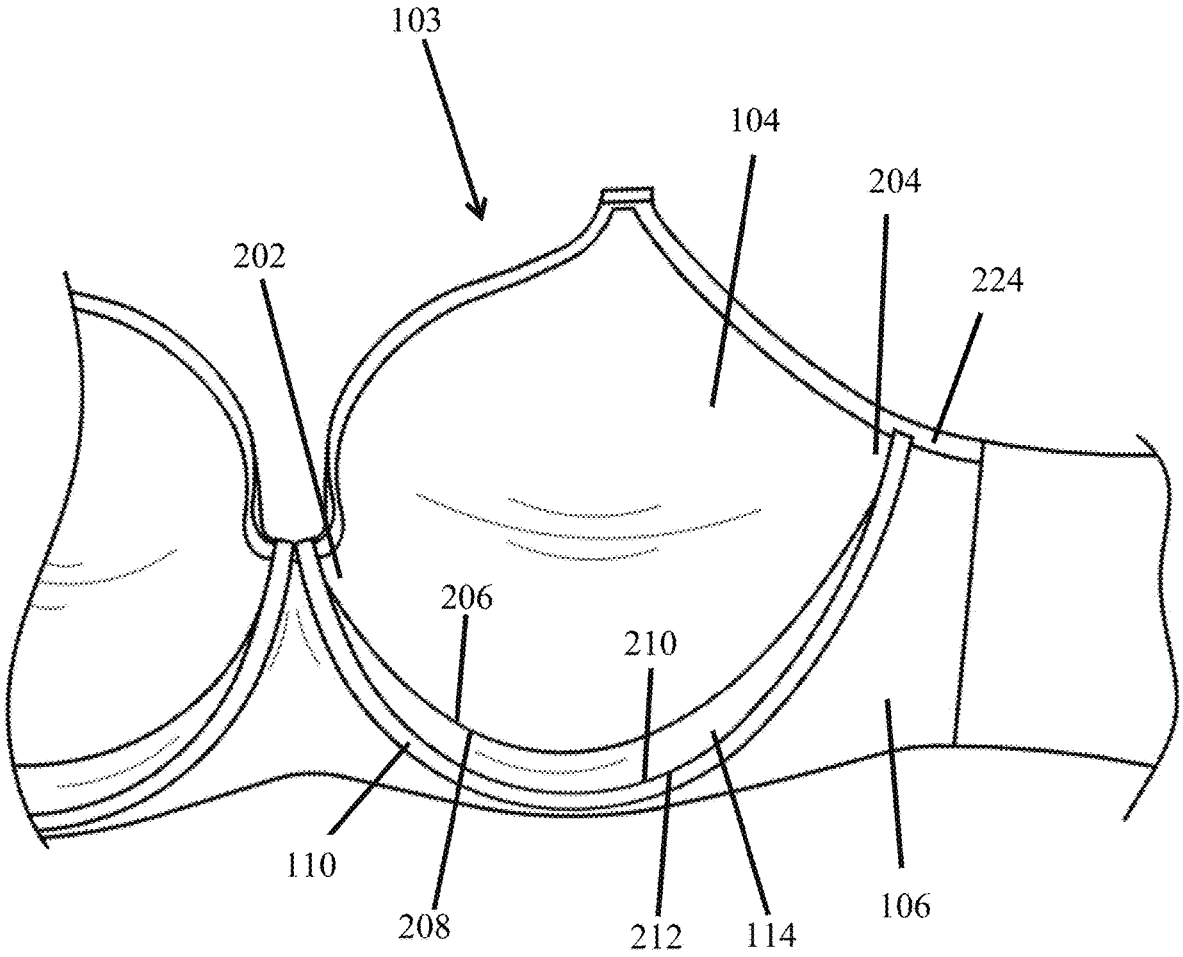
FIG. 2 depicts a rear perspective view of the right bra cup of the bra shown in FIG. 1.

Turning now to FIG. 2, shown is a close-up of a rear perspective view of right bra cup configuration (103), which more closely illustrates the details thereof. It should be understood that bra cup configurations (101 and 103) are substantially the same and thus the following description of bra cup configuration (103) applies equally to bra cup configuration (101). Bra cup configuration (103) comprises bra cup (104), underwire channel (110) and intermediary flexible layer (114) arranged in the configuration shown in FIG. 2.

As shown in FIG. 2, bra cup (104) is only directly affixed to bust support member or underwire channel (110) at two points: (1) near inner edge (202) of bra cup configuration (103), and (2) outer edge (204) of bra cup configuration (103), which is on the opposite of inner edge (202). This configuration creates an open space (not shown) between bra cup (104) and underwire channel (110) where these two components are not directly connected. Intermediary flexible layer (114) is provided in this open space and indirectly connects bra cup (104) and underwire channel (110) as illustrated in FIG. 2. That is, bra cup configuration (103) is configured such that a portion of bottom edge (206) of bra cup (104) is affixed to top edge (208) of intermediary flexible layer (114) and bottom edge (210) of intermediary flexible layer (114) is affixed to top edge (212) of underwire channel (110).

In other words, bra cup configuration (103) is configured such that at least a portion of bottom edge (206) of bra cup (104) is not directly affixed to top edge (212) of underwire channel (110). Instead, as shown, intermediary flexible layer (114) is provided between the aforementioned portion of bottom edge (206) of bra cup (104) and top edge (212) of underwire channel (110), such that intermediary flexible layer (114) connects those components together. Intermediary flexible layer (114) comprises stretchable material such as LYCRA®, spandex, elastane, rubber, polyester, nylon and the like. This aforementioned configuration of bra cup configuration (103) in combination with the flexible material of intermediary flexible layer (114) allows bra cup (104) to stretch away from and contract back to underwire channel (110), as needed, to accommodate the wearer's breasts. Intermediary flexible layer (114) may also comprise additional or excess fabric, which may also be made from LYCRA®, spandex, elastane, rubber, polyester, nylon and the like, to allow the bra cup to stretch even further, if necessary.

The size of the portion of bottom edge (206) of bra cup (104) that is affixed to underwire channel (110) via intermediary flexible layer (114) directly affects the stretchability of bra cup (104). For example, if all or nearly all of bottom edge (206) of bra cup (104) is connected to underwire channel (110) via intermediary flexible layer (114), bra cup (104) is configured such that it can achieve maximum stretch-ability. Conversely, if only a small portion of bottom edge (206) of bra cup (104) is connected to underwire channel (110) via intermediary flexible layer (114) and a majority of bottom (206) of bra cup (104) is directly affixed to underwire channel (110), bra cup (104) will be comparatively less stretchable.

Figure 3:
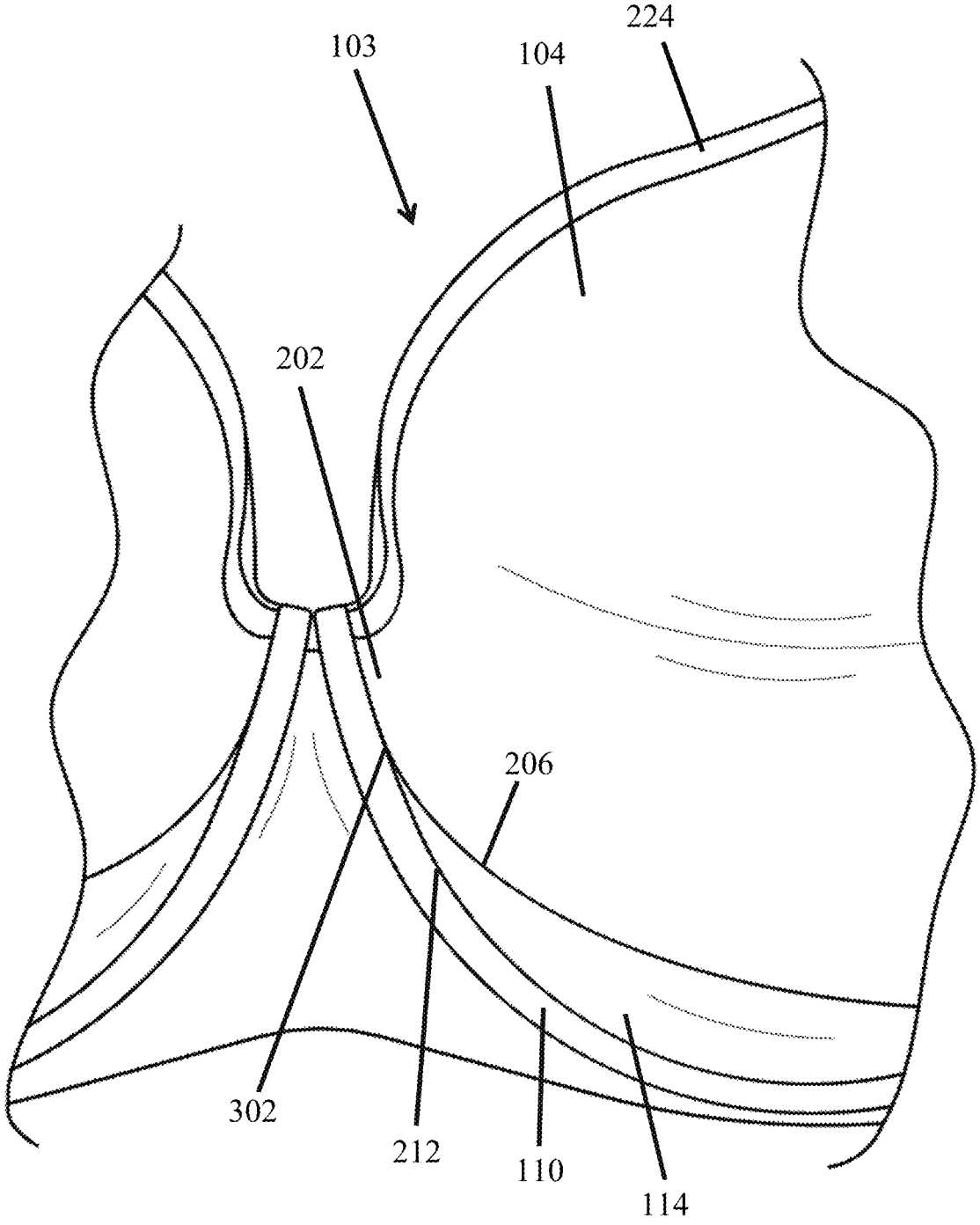
FIG. 3 depicts a close-up view of the inner edge of the right bra cup shown in FIG. 2.

FIG. 3 illustrates a close-up, rear perspective view of inner edge (202) of bra cup configuration (103). As shown, intermediary flexible layer (114) extends along the bottom of bra cup (104) towards inner edge (202) of bra cup configuration (103) and is provided between bra cup (104) and underwire channel (110). As further shown, intermediary flexible layer (114) tapers as it approaches inner edge (202) and is connected or sewn to both bottom edge (206) of bra cup (104) and top edge (212) of underwire channel (110) at connection point (302) of bra cup configuration (103) so that intermediary flexible layer (114) contains less or negligible excess fabric at connection point (302) and as it leads up to connection point (302). All three components, bra cup (104), intermediary flexible layer (114), and underwire channel (110), may be affixed or sewn together at connection point (302). With intermediary flexible layer (114) containing less or negligible excess fabric as it tapers to connection point (302), the bra cup's ability to stretch is reduced near that point, and thus more support is provided to the wearer's breasts in that area.

Figure 4:
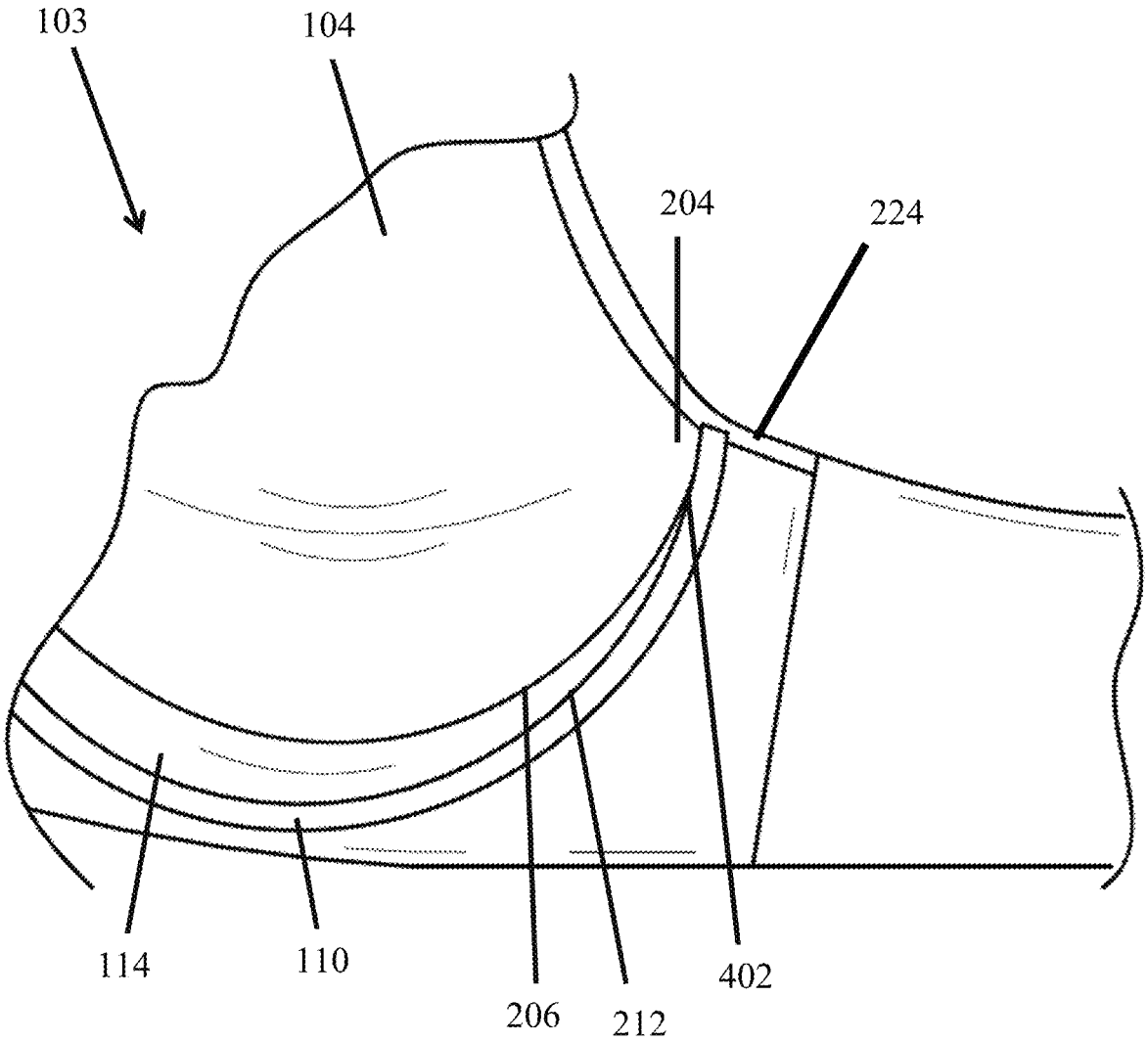
FIG. 4 depicts a close-up view of the outer edge of the right bra cup shown in FIG. 2.

FIG. 4 illustrates a close-up, rear perspective view of outer edge (204) of bra cup configuration (103). As shown, intermediary flexible layer (114) extends along the bottom of bra cup (104) towards outer edge (204) of bra cup configuration (103) and is provided between bra cup (104) and underwire channel (110). As further shown, intermediary flexible layer (114) tapers as it approaches outer edge (204) and is connected or sewn to both bottom edge (206) of bra cup (104) and top edge (212) of underwire channel (110) at connection point (402) of bra cup configuration (103) so that intermediary flexible layer (114) contains less or negligible excess fabric at connection point (402) and as it leads up to connection point (402). All three components, bra cup (104), intermediary flexible layer (114), and underwire channel (110), may be affixed or sewn together at connection point (402). With intermediary flexible layer (114) containing less or negligible excess fabric as it tapers to connection point (402), the bra cup's ability to stretch is reduced near that point, and thus more support is provided to the wearer's breasts in that area.

While bra cup configuration (103)—e.g., the right bra cup configuration—of the present disclosure has been shown and described in detail, it should be appreciated that bra cup configuration (101)—e.g., the left bra cup configuration—is essentially a mirror image thereof. As such, the drawings and disclosure of bra cup configuration (103) apply equally to bra cup configuration (101) of the present disclosures.

It should be understand that if no underwire channel, band or other bust support component is provided, the intermediary flexible layers may be disposed between the bottom of the bra cups and the front portion of the bra.

It is further contemplated that the bra of the present disclosure may incorporate the bra pads disclosed and described in commonly owned, co-pending application filed on the same date as the present application by inventors Emily Suess and Valerie Ann McArdle and Applicant Chico's Brands Investments, Inc., entitled "Bra Pad and Method for Manufacturing Same."

While the subject matter discussed herein has been described in detail with reference to embodiments for the purposes of making a complete disclosure, such embodiments are merely exemplary and are not intended to be limiting or represent an exhaustive enumeration of all aspects of the invention. It will be apparent to those of ordinary skill in the art that numerous changes may be made in such details, and the invention is capable of being embodied in other forms, without departing from the spirit, essential characteristics, and principles of the invention. Also, the benefits, advantages, solutions to problems, and any elements that may allow or facilitate any benefit, advantage, or solution are not to be construed as critical, required, or essential to the subject matter disclosed. The scope of the invention is to be limited only by the appended claims.

What is claimed is:

1. An article of clothing to support breasts of a wearer, comprising:

a first support panel, a second support panel, and a bra portion between the first support panel and the second support panel, the bra portion comprising:

an upper edge portion extending along an entire upper length of the bra portion;

first and second laterally positioned bra cups configured to receive the breasts of the wearer, each bra cup having an inner edge and an outer edge, wherein the inner edges of the bra cups are near a sternum of the wearer when the article of clothing is worn, and the outer edges of the bra cups are near sides of the wearer's body when the article of clothing is worn;

first and second intermediary flexible layers, each intermediary flexible layer having an inner edge and an outer edge, wherein a top portion of the first intermediary flexible layer is connected along a bottom portion of the first bra cup such that the outer edge of the first intermediary flexible layer is spaced apart from the outer edge of the first bra cup, and a top portion of the second intermediary flexible layer is connected along a bottom portion of the second bra cup such that the outer edge of the second intermediary flexible layer is spaced apart from the outer edge of the second bra cup; and first and second bust support members, each bust support member having an inner edge and an outer edge, wherein a top portion of the first bust support member is connected to a bottom portion of the first intermediary flexible layer and a top portion of the second bust support member is connected to a bottom portion of the second intermediary flexible layer;

wherein proximal ends of the first and second bust support members overlap an entire thickness of the upper edge portion of the bra portion; and wherein distal ends of the first and second bust support members partially overlap the upper edge portion of the bra portion.

2. The article of clothing of claim 1, wherein the inner edge of the first bust support member is connected to the inner edge of the first bra cup.

3. The article of clothing of claim 1, wherein the outer edge of the first bust support member is connected to the outer edge of the first bra cup.

4. The article of clothing of claim 1, wherein the inner edge of the second bust support member is connected to the inner edge of the second bra cup.

5. The article of clothing of claim 1, wherein the outer edge of the second bust support member is connected to the outer edge of the second bra cup.

6. The article of clothing of claim 1, wherein the article of clothing is selected from the group consisting of: a bra, a camisole, a tank top, a slip, a dress, and a bathing suit.

7. The article of clothing of claim 1, wherein the first and second intermediary flexible layers comprise one of spandex, elastane, rubber, polyester, and nylon.

8. The article of clothing of claim 1, wherein the first and second bust support members are selected from the group consisting of an underwire channel comprising a wire, a bust support band and a panel.

9. An article of clothing to support breasts of a wearer, comprising:

a first support panel, a second support panel, and a bra portion between the first support panel and the second support panel, the bra portion comprising:

first and second laterally positioned bra cup configurations, the first bra cup configuration comprising:

a first bra cup configured to receive one of the breasts of the wearer, the first bra cup having an inner edge and an outer edge, a first bust support member having an inner edge and an outer edge, wherein the first bust support member is connected to the first bra cup near the respective inner edges of the first bust support member and the first bra cup, and near the respective outer edges of the first bust support member and the first bra cup such that a space is formed between the first bra cup and the first bust support member, and a first intermediary flexible layer having an inner edge and an outer edge, wherein the first intermediary flexible layer is disposed within the space formed between the first bra cup and the first bust support member, wherein the first intermediary flexible layer is configured to connect a portion of the first bra cup to the first bust support member, and wherein the outer edge of the first intermediary flexible layer is spaced apart from the outer edge of the first bra cup; and the second bra cup configuration comprising:

a second bra cup configured to receive one of the breasts of the wearer, the second bra cup having an inner edge and an outer edge, wherein the inner edges of the first and second bra cups are near a sternum of the wearer when the article of clothing is worn, and the outer edges of the first and second bra cups are near sides of the wearer's body when the article of clothing is worn, a second bust support member having an inner edge and an outer edge, wherein the second bust support member is connected to the second bra cup near the respective inner edges of the second bust support member and the second bra cup, and near the respective outer edges of the second bust support member and the second bra cup such that a space is formed between the second bra cup and the second bust support member, and a second intermediary flexible layer having an inner edge and an outer edge, wherein the second intermediary flexible layer is disposed within the space formed between the second bra cup and the second bust support member, wherein the second intermediary flexible layer is configured to connect a portion of the second bra cup to the second bust support member, and wherein the outer edge of the second intermediary flexible layer is spaced apart from the outer edge of the second bra cup;

wherein proximal ends of the first and second bust support members overlap an entire thickness of the upper edge portion of the bra portion; and wherein distal ends of the first and second bust support members partially overlap the upper edge portion of the bra portion.

10. An article of clothing to support breasts of a wearer, comprising:

a first support panel, a second support panel, and a bra portion between the first support panel and the second support panel, the bra portion comprising:

first and second laterally positioned bra cups configured to receive the breasts of the wearer, each bra cup having an inner edge and an outer edge, wherein the inner edges of the bra cups are near a sternum of the wearer when the article of clothing is worn, and the outer edges of the bra cups are near sides of the wearer's body when the article of clothing is worn;

first and second bust support members, each bust support member having an inner edge and an outer edge; and first and second flexible fabrics, each flexible fabric having an inner edge and an outer edge, the first flexible fabric is disposed in a first space formed between the first bra cup and the first bust support member such that the outer edge of the first flexible fabric is spaced apart from the outer edge of the first bra cup, and the second flexible fabric is disposed in a second space formed between the second bra cup and the second bust support member such that the outer edge of the second flexible fabric is spaced apart from the outer edge of the second bra cup;

wherein proximal ends of the first and second bust support members overlap an entire thickness of the upper edge portion of the bra portion; and wherein distal ends of the first and second bust support members partially overlap the upper edge portion of the bra portion.

11. The article of clothing of claim 10, wherein the inner edge of the first bust support member is connected to the inner edge of the first bra cup, and further wherein the outer edge of the first bust support member is connected to the outer edge of the first bra cup.

12. The article of clothing of claim 10, wherein the inner edge of the second bust support member is connected to the inner edge of the second bra cup, and further wherein the outer edge of the second bust support member is connected to the outer edge of the second bra cup.

13. The article of clothing of claim 10, wherein the first and second flexible fabrics comprise one of spandex, elastane, rubber, polyester, and nylon.

14. An article of clothing to support breasts of a wearer, comprising:

a first support panel, a second support panel, and a bra portion between the first support panel and the second support panel, the bra portion comprising:

first and second laterally positioned bra cups configured to receive the breasts of the wearer, each bra cup having an inner edge and an outer edge, wherein the inner edges of the bra cups are near a sternum of the wearer when the article of clothing is worn, and the outer edges of the bra cups are near sides of the wearer's body when the article of clothing is worn;

first and second bust support members, each bust support member having an inner edge and an outer edge; and first and second flexible components, each flexible component having an inner edge and an outer edge, the first flexible component is disposed in a first space formed between the first bra cup and the first bust support member such that the outer edge of the first flexible component is spaced apart from the outer edge of the first bra cup, and the second flexible component is disposed in a second space formed between the second bra cup and the second bust support member such that the outer edge of the second flexible component is spaced apart from the outer edge of the second bra cup;

wherein proximal ends of the first and second bust support members overlap an entire thickness of the upper edge portion of the bra portion; and wherein distal ends of the first and second bust support members partially overlap the upper edge portion of the bra portion.

15. The article of clothing of claim 14, wherein the first and second flexible components comprise one of spandex, elastane, rubber, polyester, and nylon.

* * * * *